US007431521B2

(12) United States Patent
Kakegawa

(10) Patent No.: US 7,431,521 B2
(45) Date of Patent: Oct. 7, 2008

(54) PRINTING METHOD, PRINTING APPARATUS, AND COMPUTER-READABLE STORAGE MEDIUM FOR SHORTENING STOPPAGE PERIOD OF BOTH MOTORS

(75) Inventor: Tomoyoshi Kakegawa, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 42 days.

(21) Appl. No.: 11/092,971

(22) Filed: Mar. 30, 2005

(65) Prior Publication Data

US 2005/0232674 A1 Oct. 20, 2005

(30) Foreign Application Priority Data

Mar. 31, 2004 (JP) ..... 2004-105568
Feb. 24, 2005 (JP) ..... 2005-049521

(51) Int. Cl.
*B41J 19/00* (2006.01)

(52) U.S. Cl. ..... 400/319; 400/582

(58) Field of Classification Search ..... 400/319, 400/582, 578, 283; 347/19, 17, 14, 37
See application file for complete search history.

(56) References Cited

U.S. PATENT DOCUMENTS 4,884,162 A * 11/1989 Ito et al. ..... 361/23
5,631,677 A * 5/1997 Horigome et al. ..... 347/19
6,364,551 B1 * 4/2002 Lesniak et al. ..... 400/582
6,609,777 B2 * 8/2003 Endo ..... 347/19
6,702,420 B2 * 3/2004 Tanaka ..... 347/19
6,712,440 B2 * 3/2004 Shoji ..... 347/14
6,719,396 B2 * 4/2004 Anzai ..... 347/19
2001/0026722 A1 * 10/2001 Uchikata ..... 400/283
2003/0063142 A1 * 4/2003 Sakamoto et al. ..... 347/5
2003/0085936 A1 * 5/2003 Tanaka ..... 347/11
2003/0198705 A1 * 10/2003 Foreman et al. ..... 425/174.4
2004/0052565 A1 * 3/2004 Takeishi ..... 400/283
2005/0088469 A1 * 4/2005 Igarashi ..... 347/14

FOREIGN PATENT DOCUMENTS

JP 2002-186285 A 6/2002

* cited by examiner

*Primary Examiner*—Anthony H. Nguyen
(74) *Attorney, Agent, or Firm*—Sughrue Mion, PLLC

(57) ABSTRACT

A printing method includes the steps of: preparing a printing apparatus that is provided with a movement motor for moving an ink ejecting section that ejects ink onto a medium, and a carry motor for carrying the medium; repeating driving and stopping of both motors, and alternately driving the movement motor and the carry motor such that a timing, with respect to a timing at which one motor stops driving, at which the other motor starts to drive is at a predetermined timing; changing a stop time of the one motor; and when the stop time of the one motor has become longer than the stop time before being changed, delaying the timing at which the other motor starts to drive compared to the predetermined timing.

16 Claims, 12 Drawing Sheets

PRINTING METHOD, PRINTING APPARATUS, AND COMPUTER-READABLE STORAGE MEDIUM FOR SHORTENING STOPPAGE PERIOD OF BOTH MOTORS

CROSS-REFERENCE TO RELATED APPLICATIONS

The present application claims priority upon Japanese Patent Application No. 2004-105568 filed on Mar. 31, 2004 and Japanese Patent Application No. 2005-049521 filed on Feb. 24, 2005, which are herein incorporated by reference.

BACKGROUND OF THE INVENTION

1. Field of the Invention

The present invention relates to printing methods, printing apparatuses, and computer-readable storage media.

2. Description of the Related Art

Inkjet printers are known as one type of printing apparatus that executes printing by ejecting liquid toward a medium. Inkjet printers executes printing by ejecting ink as the liquid onto a medium such as paper. An inkjet printer effects printing by alternately repeating a dot formation process of driving a movement motor to move nozzles that can be moved in a predetermined movement direction and ejecting ink while moving the nozzles to form dots on a medium, and a carry process of driving a carry motor to carry the medium, thereby forming an image on the medium.

In such printing apparatuses, the motors generate heat while they are being driven, and the motors are cooled by radiating off heat while they are stopped during their stop time. However, the normal period during which the motors are stopped may not allow them to sufficiently cool down. A conceivable method for such a case is cool the motors by lengthening the period for which they are stopped (see, for example, JP 2002-186285A). When the motors' stopped state becomes long in this way, the user feels the drop in printing speed and this may cause the user stress.

SUMMARY OF THE INVENTION

When two motors are driven in alternation, however, lengthening the stop period of one motor also lengthens the state in which the two motors are both stepped. For example, if the movement motor generates heat and becomes hot and its stop period is lengthened as a result, then the state in which both the movement motor and the carry motor are kept stopped (both-motor stopped state) becomes longer.

The present invention was arrived at in light of the foregoing matters, and it is an object thereof to shorten the period during which both the movement motor and the carry motor are stopped.

An aspect of the present invention is a printing method comprising the steps of: preparing a printing apparatus that is provided with a movement motor for moving an ink ejecting section that ejects ink onto a medium, and a carry motor for carrying the medium; repeating driving and stopping of both motors, and alternately driving the movement motor and the carry motor such that a timing, with respect to a timing at which one motor stops driving, at which the other motor starts to drive is at a predetermined timing; changing a stop time of the one motor; and when the stop time of the one motor has become longer than the stop time before being changed, delaying the timing at which the other motor starts to drive compared to the predetermined timing.

Other features of the present invention will become clear through the accompanying drawings and the following description.

DETAILED DESCRIPTION OF THE INVENTION

Figure 1:
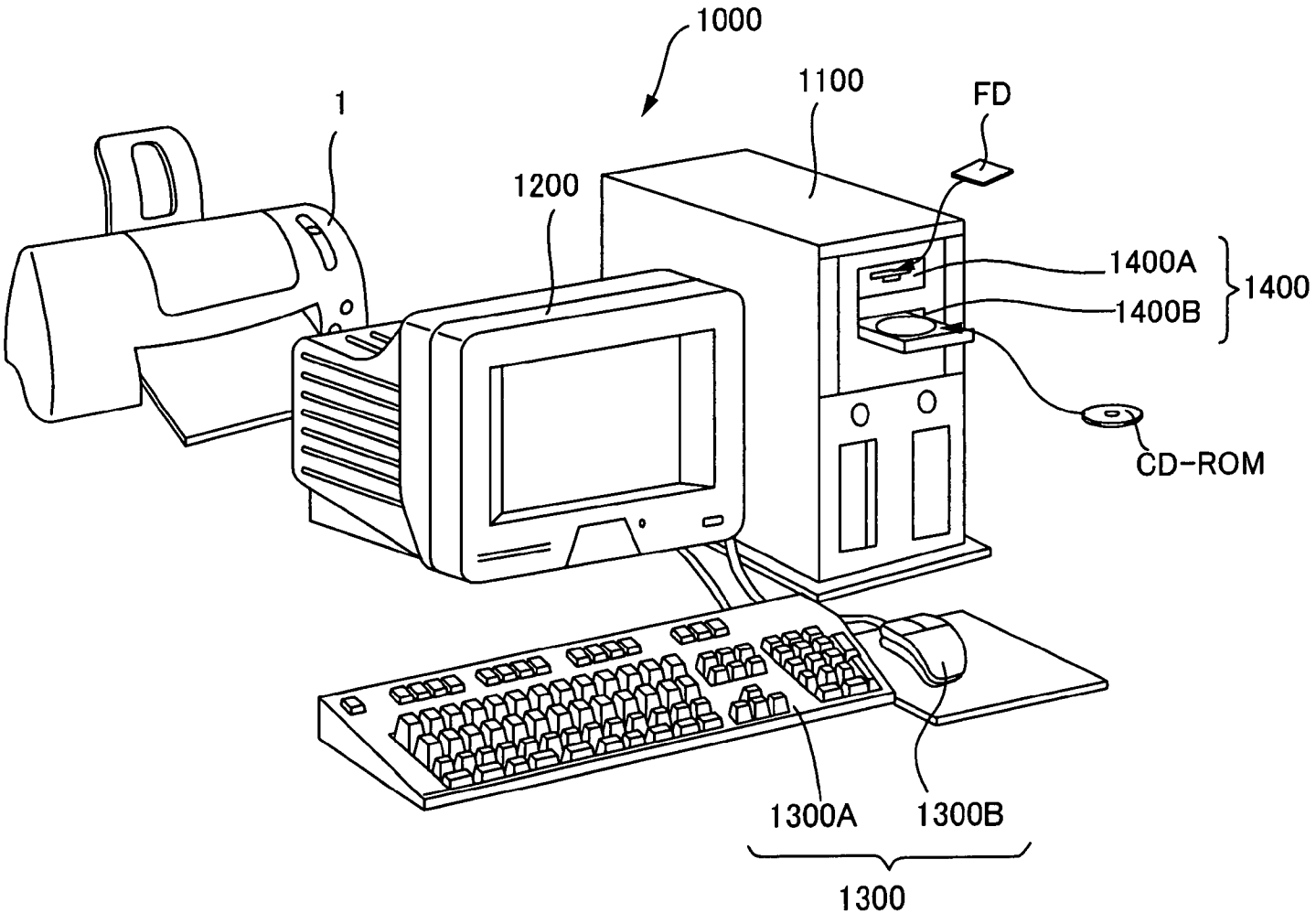
FIG. 1 is an explanatory diagram showing the external structure of a printing system.

At least the following matters will become clear by the explanation in the present specification and the description of the accompanying drawings.

A printing method comprises the steps of: preparing a printing apparatus that is provided with a movement motor for moving an ink ejecting section that ejects ink onto a medium, and a carry motor for carrying the medium; repeating driving and stopping of both motors, and alternately driving the movement motor and the carry motor such that a timing, with respect to a timing at which one motor stops driving, at which the other motor starts to drive is at a predetermined timing; changing a stop time of the one motor; and when the stop time of the one motor has become longer than the stop time before being changed, delaying the timing at which the other motor starts to drive compared to the predetermined timing.

With this printing method, the user is less likely to feel that the printing speed has become slow, and this keeps the user from experiencing undue stress.

In this printing method, it is preferable that the stop time of the one motor is changed according to a temperature of the one motor. It is also preferable that the printing apparatus further comprises a temperature sensor for detecting the temperature of the one motor; and that, when a detection result of the temperature sensor exceeds a predetermined temperature, the stop time of the one motor is made longer than before the detection result of the temperature sensor exceeds the predetermined temperature. Alternatively, it is also preferable that the temperature of the one motor is calculated based on a drive amount of the one motor; and that the stop time of the one motor is changed according to the temperature of the one motor that has been calculated. With this printing method, cooling of the motor can be performed in accordance with the temperature of the motor.

In this printing method, it is preferable that the stop time of the one motor is set according to the temperature of the one motor. In this way, it is possible to perform cooling that is suited for the temperature of the motor.

In this printing method, it is preferable that, before changing the stop time to make the stop time become longer, there is a state where the one motor and the other motor are driven simultaneously. By shortening or eliminating the time during which both motors are driven simultaneously, it is possible to shorten the both-motor stopped state.

In this printing method, it is preferable that, before changing the stop time to make the stop time become longer, driving of the other motor is started before driving of the one motor is stopped. It is also preferable that, before changing the stop time to make the stop time become longer, driving of the other motor is started when the one motor begins to decelerate. In this way, the printing speed can be increased. It is also preferable that, when the stop time has become longer than before being changed, driving of the other motor is started at the same time that the one motor is stopped. It is also preferable that, when the stop time has become longer than before being changed, driving of the other motor is started after the one motor has stopped. In this way, the state in which both motors are driven simultaneously is eliminated, and therefore, it is possible to shorten the both-motor stopped state.

In this printing method, it is preferable that, when the stop time has become longer than before being changed, there are periods during which neither the movement motor nor the carry motor are driven, before the other motor starts to drive and after the other motor has stopped driving. In this way, the both-motor stopped state can be distributed.

In this printing method, it is preferable that, when the stop time has become longer than before being changed, the timing at which the other motor starts to drive is delayed compared to the predetermined timing such that a time during which both the movement motor and the carry motor are kept in a continuously stopped state becomes shorter. In this way, it is possible to keep the user from experiencing undue stress.

In this printing method, it is preferable that, when the stop time has become longer than before being changed, the other motor is not driven while the one motor is being driven. In this way, it is possible to shorten the both-motor stopped state.

In this printing method, it is preferable that, after the stop time of the one motor has been determined, the timing at which the other motor starts to drive is determined according to the stop time that has been determined. In this way, it is possible to shorten the both-motor stopped state.

Another printing method comprises the steps of: preparing a printing apparatus that is provided with a movement motor for moving an ink ejecting section that ejects ink onto a medium, and a carry motor for carrying the medium; repeating driving and stopping of both motors, and alternately driving the movement motor and the carry motor such that a timing, with respect to a timing at which one motor stops driving, at which the other motor starts to drive is at a predetermined timing; changing a stop time of the one motor; and when the stop time of the one motor has become longer than the stop time before being changed, delaying the timing at which the other motor starts to drive compared to the predetermined timing; wherein the stop time of the one motor is changed according to a temperature of the one motor; wherein the temperature of the one motor is calculated based on a drive amount of the one motor; wherein the stop time of the one motor is changed according to the temperature of the one motor that has been calculated; wherein the stop time of the one motor is set according to the temperature of the one motor; wherein, before changing the stop time to make the stop time become longer, there is a state where the one motor and the other motor are driven simultaneously, driving of the other motor is started before driving of the one motor is stopped, and driving of the other motor is started when the one motor begins to decelerate; wherein, when the stop time has become longer than before being changed, driving of the other motor is started after the one motor has stopped, there are periods during which neither the movement motor nor the carry motor are driven, before the other motor starts to drive and after the other motor has stopped driving, the timing at which the other motor starts to drive is delayed compared to the predetermined timing such that a time during which both the movement motor and the carry motor are kept in a stopped state becomes shorter, and the other motor is not driven while the one motor is being driven; and wherein, after the stop time of the one motor has been determined, the timing at which the other motor starts to drive is determined according to the stop time that has been determined.

With this printing method, because all of the foregoing effects are attained, the object of the present invention can be most effectively achieved.

Further, a printing apparatus comprises: a movement motor for moving an ink ejecting section that ejects ink onto a medium; and a carry motor for carrying the medium; wherein both motors are repeatedly driven and stopped; wherein a stop time of at least one motor of the movement motor and the carry motor is changeable; wherein the movement motor and the carry motor perform driving alternately such that a timing, with respect to a timing at which the one motor stops driving, at which the other motor starts to drive is at a predetermined timing; and wherein, when the stop time of the one motor is changed and has become longer than the stop time before being changed, the timing at which the other motor starts to drive is delayed compared to the predetermined timing.

With this printing apparatus, it becomes less likely for the user to feel that the printing speed has dropped, and this keeps the user from experiencing undue stress.

Further, it is also possible to achieve a computer-readable storage medium having stored thereon a program, the program comprising: a code for repeating driving and stopping of a movement motor for moving an ink ejecting section that ejects ink onto a medium, and a carry motor for carrying the medium, and for alternately driving the movement motor and the carry motor such that a timing, with respect to a timing at which the one motor stops driving, at which the other motor starts to drive is at a predetermined timing; a code for changing a stop time of the one motor; and a code for delaying the timing at which the other motor starts to drive compared to the predetermined timing, when the stop time of the one motor has been changed to become longer than the stop time before being changed.

With this program, a printing apparatus can be controlled such that the user does not experience undue stress.

===Overview of Printing Apparatus===

An overview of a printing system provided with a printer 1 and a computer 1100 is described below as an example embodiment of a printing apparatus according to the present invention.

FIG. 1 is an explanatory diagram showing the external structure of a printing system 1000 according to the present embodiment. The printing system 1000 is provided with a printer 1 and a computer 1100. The computer 1100 includes a display device 1200, an input device 1300, and a record/play device 1400. The printer 1 is a printing apparatus for printing images on a medium such as paper, cloth, or film. The computer 1100 is electrically connected to the printer 1, and outputs print data corresponding to an image to be printed to the printer 1 in order to cause the printer 1 to print the image. The display device 1200 has a display and displays a user interface of, for example, an application program or a printer driver. The input device 1300 is for example a keyboard 1300A and a mouse 1300B, and is used to operate the application program or adjust the settings of the printer driver, for example, in accordance with the user interface that is displayed on the display device 1200. A flexible disk drive device 1400A and a CD-ROM drive device 1400B, for example, are employed as the record/play device 1400.

A printer driver is installed on the computer 1100. The printer driver is a program for achieving the function of displaying the user interface on the display device 1200, and in addition it also achieves the function of converting image data that have been output from the application program into print data. The printer driver is recorded on a storage medium (computer-readable storage medium) such as a flexible disk FD or a CD-ROM. Further, the printer driver can be downloaded onto the computer 1100 via the Internet. It should be noted that this program is constituted by codes for achieving the various functions.

===Configuration of the Printer 1===

Figure 2:
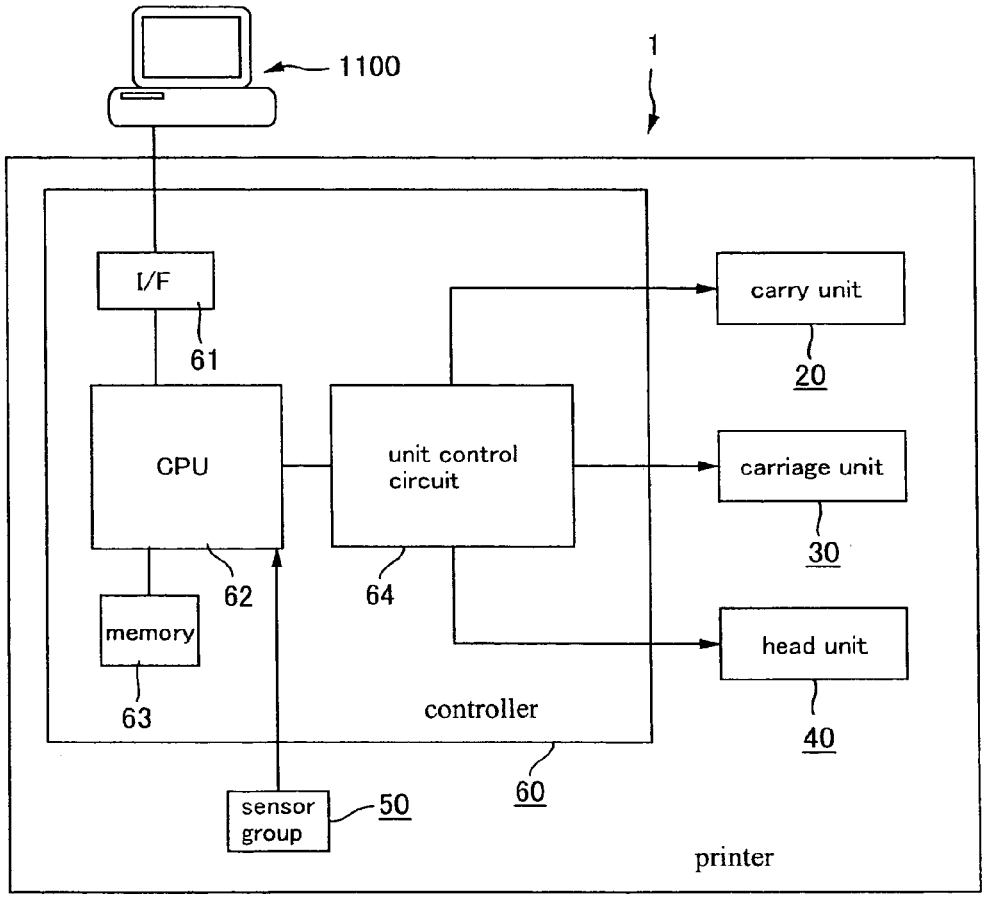
FIG. 2 is a block diagram of the overall structure of a printer.
Figure 3:
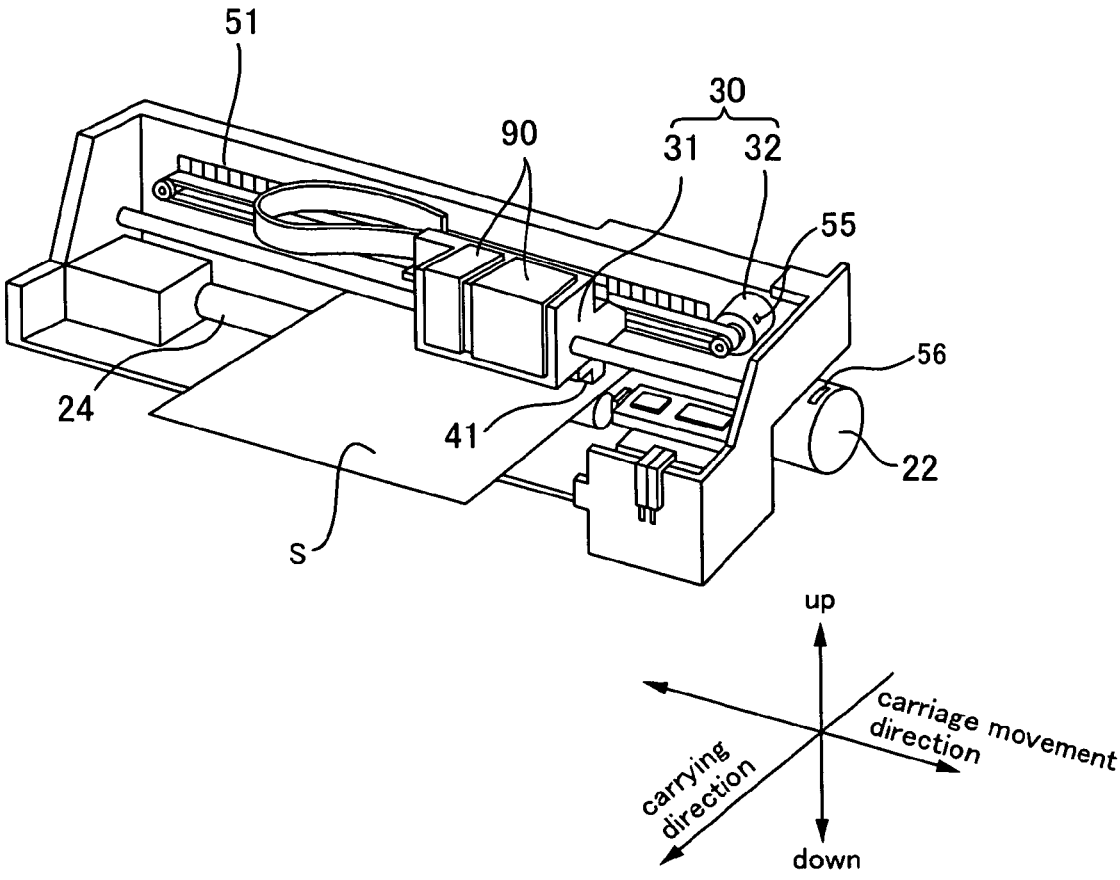
FIG. 3 is a schematic diagram of the overall structure of the printer.
Figure 4:
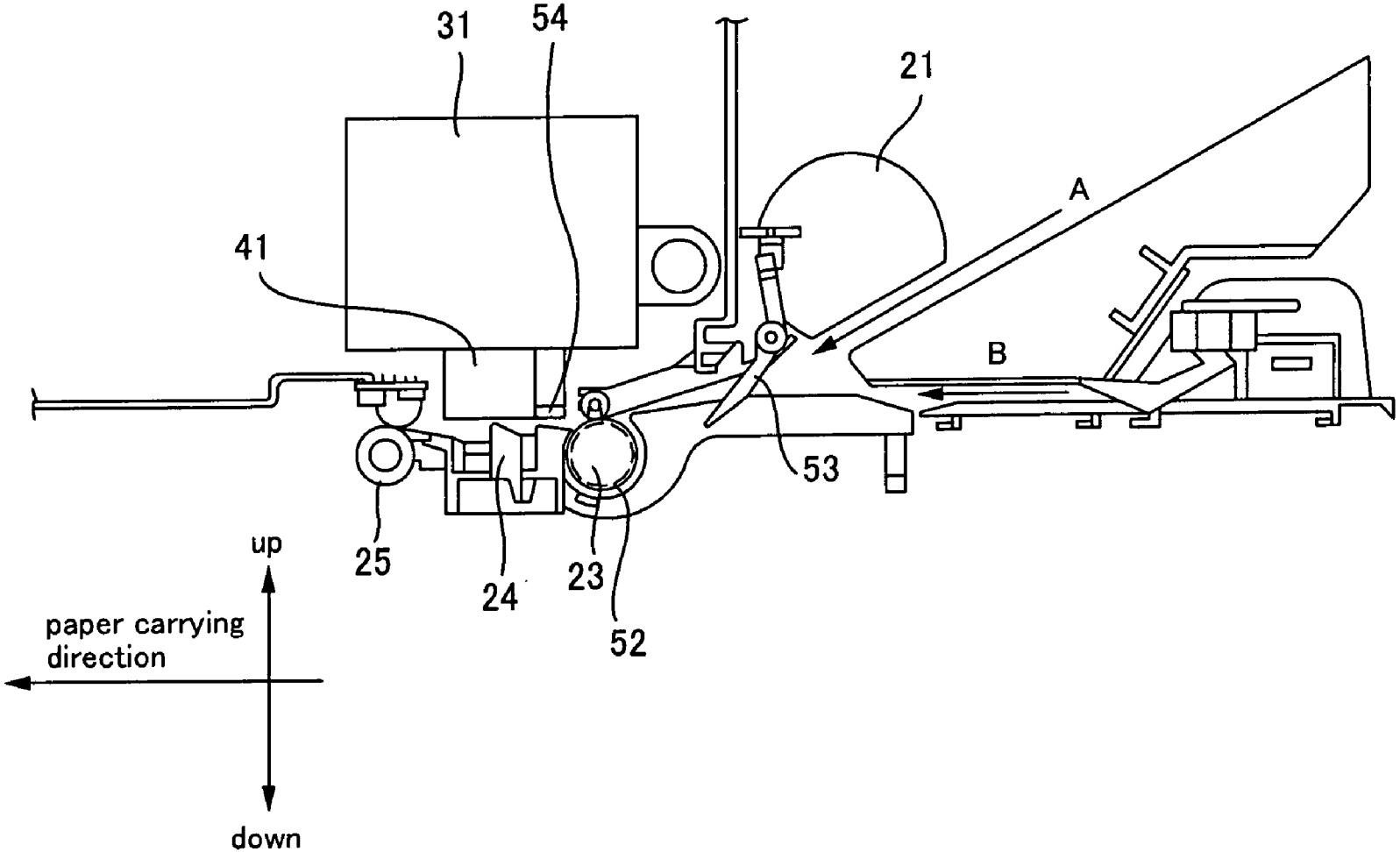
FIG. 4 is a vertical sectional view of the overall structure of the printer.

FIG. 2 is a block diagram of the overall configuration of the printer 1 of this embodiment. FIG. 3 is perspective view of the internal structure of the printer 1 of this embodiment. Further, FIG. 4 is a vertical sectional view of the internal structure of the printer 1 of this embodiment. The basic structure of the printer 1 of the present embodiment is described below.

As shown in FIG. 2, the printer 1 of this embodiment has a carry unit 20, a carriage unit 30, a head unit 40, a sensor group 50, and a controller 60. The printer 1 that has received print data from the computer 1100, which is an external device, controls the various units (the carry unit 20, the carriage unit 30, and the head unit 40) using the controller 60. The controller 60 controls the units in accordance with the print data that are received from the computer 1100 to form an image on a medium S. The sensor group 50 monitors the conditions within the printer 1, and it outputs the results of this detection to the controller 60. The controller receives the detection results from the sensor, and controls the units based on these detection results.

The carry unit 20 is for feeding a medium (for example, paper) to a printable position and carrying the medium S in a predetermined direction (hereinafter, referred to as the carrying direction) by a predetermined carry amount during printing. In other words, the carry unit 20 functions as a carrying mechanism (carrying means) that carries the medium. The carry unit 20, as shown in FIG. 4, has a paper supply roller 21, a carry motor (also referred to as PF motor) 22, a carry roller 23, a platen 24, and a paper discharge roller 25. However, the carry unit 20 does not necessarily have to include all of these structural elements in order to function as a carrying mechanism. The paper supply roller 21 is a roller for automatically supplying, into the printer 1, the medium S that has been inserted into the paper insert opening. The paper supply roller 21 has a transverse cross-sectional shape in the letter D, and the length of the circumference section thereof is set longer than the carrying distance to the carry roller 23, so that using this circumference section the medium S can be carried up to the carry roller 23. The carry motor 22 is a motor for carrying the medium S in the carrying direction, and is constituted by a DC motor. The carry roller 23 is a roller for carrying the medium S that has been supplied by the paper supply roller 21 up to a printable region, and is driven by the carry motor 22. The platen 24 supports the medium S during printing. The paper discharge roller 25 is a roller for discharging the medium S for which printing has finished to the outside of the printer 1. The paper discharge roller 25 is rotated in synchronization with the carry roller 23.

The carriage unit 30 is for moving the head in a predetermined direction (hereinafter, referred to as "carriage movement direction"). As shown in FIG. 3, the carriage unit 30 has a carriage 31 and a carriage motor (also referred to as "CR motor") 32. The carriage 31 is capable of moving back and forth (and thus the head moves in the carriage movement direction). Further, the carriage 31 detachably holds ink cartridges that contain ink. The carriage motor 32 is a motor for moving the carriage 31 in the carriage movement direction, and is constituted by a DC motor.

The head unit 40 is for ejecting ink onto the medium S. The head unit 40 has a head 41. The head 41 has a plurality of nozzles, which are the color ink ejecting sections of the invention, and intermittently ejects ink from the nozzles. The head 41 is provided in the carriage 31. Thus, when the carriage 31 moves in the carriage movement direction the head 41 also moves in the carriage movement direction. Dot lines (raster lines) are formed on the medium S in the carriage movement direction due to the head 41 intermittently ejecting ink while moving in the carriage movement direction.

The sensor group 50 includes a linear encoder 51 (see FIG. 3), a rotary encoder 52 (see FIG. 4), a paper detection sensor 53 (see FIG. 4), a paper width sensor 54 (see FIG. 4), a CRM temperature sensor 55 (see FIG. 3), and a PFM temperature sensor 56 (see FIG. 3).

The linear encoder 51 is for detecting the position of the carriage 31 in the carriage movement direction. The rotary encoder 52 is for detecting the amount of rotation of the carry roller 23. The paper detection sensor 53 is for detecting the position of the front end of the medium S being printed. The paper detection sensor 53 is provided in a position where it can detect the position of the front end of the medium S as the medium S is being fed toward the carry roller 23 by the paper supply roller 21. It should be noted that the paper detection sensor 53 is a mechanical sensor that detects the front end of the medium S via mechanical mechanism. More specifically, the paper detection sensor 53 has a lever that can be rotated in the paper carrying direction, and this lever is disposed so that it protrudes into the path over which the medium S is carried. Thus, the front end of the medium S comes into contact with the lever and rotates the lever, and thus the paper detection sensor 53 detects the position of the front end of the medium S by detecting the movement of the lever. The paper width sensor 54 is attached to the carriage 31. The paper width sensor 54 is an optical sensor that detects whether or not the medium S is present by detecting, with its light-receiving section, the reflected light of the light that has been irradiated onto the medium S from its light-emitting section. The paper width sensor 54 detects the positions of the edges of the medium S while being moved by the carriage 31, thereby detecting the width of the medium S. Depending on the conditions, the paper width sensor 54 is also capable of detecting the front end of the medium S. Because the paper width sensor 54 is an optical sensor it detects positions with higher precision than the paper detection sensor 53. The CRM temperature sensor 55 is provided on the surface of the carriage motor 32. The CRM temperature sensor 55 detects the temperature of the carriage motor 32 and outputs a signal with the result of this detection to the controller 60. The PFM temperature sensor 56 is provided on the surface of the carry motor 22. The PFM temperature sensor 56 detects the temperature of the carry motor 22 and outputs a signal with the result of this detection to the controller 60.

The controller 60 is a control unit (control means) for carrying out control of the printer 1. The controller 60 has an interface section 61, a CPU 62, a memory 63, and a unit control circuit 64. The interface section 61 exchanges data between the computer 1100, which is an external device, and the printer 1. The CPU 62 is a computer processing device for executing overall control of the printer 1. The memory 63 is for securing a working region and a region for storing the programs for the CPU 62, for instance, and includes memory means such as a RAM or an EEPROM. The CPU 62 controls the various units through the unit control circuit 64 according to the programs stored on the memory 63.

===Head 41===

<Regarding the Configuration of the Head>

Figure 5:
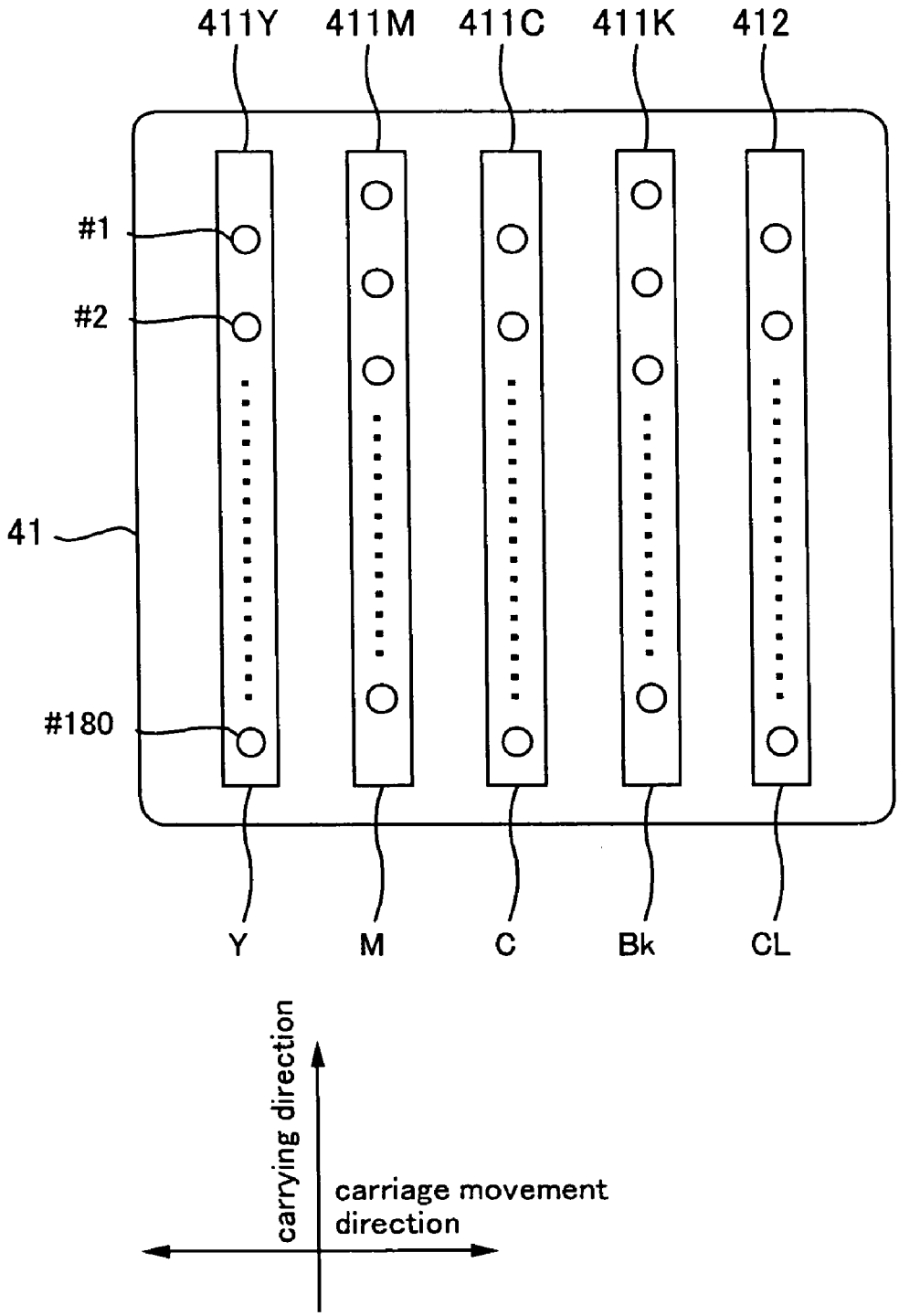
FIG. 5 is an explanatory diagram showing the arrangement of the nozzles.

FIG. 5 is an explanatory diagram showing the arrangement of the nozzles in the lower surface of the head 41. A plurality of color ink nozzle groups 411Y, 411M, 411C, and 411K are provided in the lower surface of the head 41 as shown in this drawing. In this embodiment, the yellow ink nozzle group 411Y, the magenta ink nozzle group 411M, the cyan ink nozzle group 411C, and the black ink nozzle group 411K are provided for the respective color inks, that is, yellow (Y), magenta (M), cyan (C), and black (K) ink. The nozzle groups 411Y, 411M, 411C, and 411K are each provided with a plurality (in this embodiment, 180) of nozzles #1 to #180 as ejection openings for ejecting the inks of the respective colors.

In addition to the various color ink nozzle groups 411Y, 411M, 411C, and 411K, the head 41 of this embodiment is also provided with a clear ink nozzle group 412 that ejects clear ink toward the medium S. Like the color ink nozzle groups 411Y, 411M, 411C, and 411K, the clear ink nozzle group 412 is furnished with a plurality of nozzles (in this embodiment, 180) as ejection openings for ejecting clear ink.

The plurality of nozzles #1 to #180 of the nozzle groups 411Y, 411M, 411C, 411K, and 412 are arranged in a row at a constant spacing (nozzle pitch: k·D) in the carrying direction. Here, D is the minimum dot pitch in the carrying direction (that is, the pitch at the maximum resolution at which dots are formed on the paper S). Further, k is an integer of 1 or more.

The nozzles #1 to #180 of the nozzle groups 411Y, 411M, 411C, 411K, and 412 are assigned a number (#1 to #180) that becomes smaller the more downstream the nozzle. That is, the nozzle #1 is positioned more downstream in the carrying direction than the nozzle #180. Further, the paper width sensor 54 is provided in substantially the same position as the nozzle #180, which is on the most upstream side, as regards its position in the paper carrying direction. Each nozzle #1 to #180 is provided with a piezo element (not shown) as a drive element for driving that nozzle #1 to #180 and making it eject ink.

===Regarding the Printing Operation===

Figure 6:
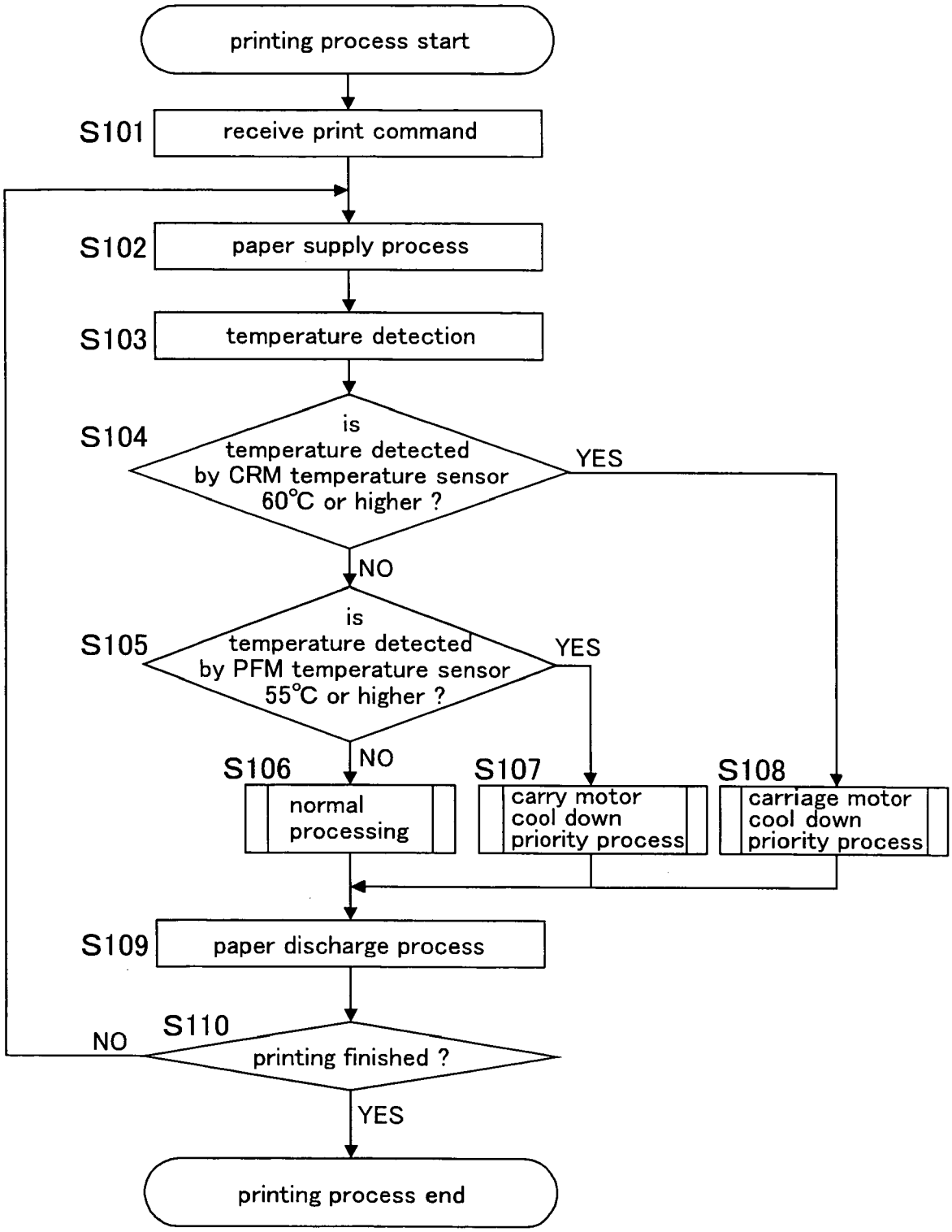
FIG. 6 is a flowchart of the processing during printing.

The process through which the printer 1 executes actual printing is described with reference to FIG. 6. FIG. 6 is a flowchart of when the printer 1 executes printing.

The processes described below are executed by the controller 60 controlling the various units in accordance with a program stored in the memory 63. This program has codes for executing the various processes.

In step S101, the controller 60 receives a print command from the computer 1100 via the interface section 61. This print command is included in the header of the print data transmitted from the computer 1100. The controller 60 then analyzes the contents of the various commands included in the print data that are received and executes the following processes.

In step S102, the controller 60 performs a paper supply process. The paper supply process is a process for supplying paper to be printed into the printer 1 and positioning the paper at a print start position (also referred to as the "indexed position"). The controller 60 rotates the paper supply roller 21 to feed the paper to be printed up to the carry roller 23. The controller 60 rotates the carry roller 23 to position the paper that has been supplied from the paper supply roller 21 at the print start position. When the paper has been positioned at the print start position, at least some of the nozzles of the head 41 are in opposition to the paper.

In step S103, the controller 60 performs temperature detection. Temperature detection is a process for detecting the temperature of the carriage motor 32 and the temperature of the carry motor 22. The carriage motor 32 is provided with the CRM temperature sensor 55, and the carry motor 22 is provided with the PFM temperature sensor 56. The controller 60 detects the temperature of the carriage motor and the temperature of the carry motor based on the signals from the CRM temperature sensor 55 and the PFM temperature sensor 56.

In step S104, the controller 60 determines whether or not the temperature of the carriage motor 32 that has been detected in the temperature detection process of step S103 exceeds a preset CRM threshold. Here, the CRM threshold is the temperature at which it becomes necessary to execute the process to lengthen the stop time of the carriage motor 32 in order to cool down the carriage motor 32. The CRM threshold is found in advance experimentally by the printer manufacturer or the motor manufacturer, and is stored on the memory 63. For example, in this embodiment the CRM threshold has been set at 60° C. The controller 60 reads the CRM threshold (60° C.) stored on the memory 63 when executing the processing of step S104, and determines whether or not the temperature of the carriage motor 32 that has been detected is higher than 60° C. When the controller 60 determines that the temperature of the carriage motor that has been detected is lower than 60° C., it advances the processing to step S105.

In step S105, the controller 60 determines whether or not the temperature of the carry motor 22 that has been detected in the temperature detection process of step S103 exceeds a preset PFM threshold. Here, the PFM threshold is the temperature at which it becomes necessary to execute the process to lengthen the stop time of the carry motor 22 in order to cool down the carry motor 22. The PFM threshold is found in advance experimentally by the printer manufacturer or the motor manufacturer, and is stored on the memory 63. For example, in this embodiment the PFM threshold has been set at 55° C. The controller 60 reads the PFM threshold (55° C.) stored on the memory 63 when executing the processing of step S105, and determines whether or not the temperature of the carry motor that has been detected is higher than 55° C. When the controller 60 determines that the temperature of the carry motor that has been detected is lower than 55° C. it advances the processing to step S106.

In step S106, the controller 60 executes normal processing. Normal processing is described later with reference to FIG. 7 and FIG. 8. In step S106, the procedure is advanced to step S109 once normal processing is over.

In step S109, the controller 60 rotates the paper discharge roller to discharge the printed paper to the outside.

In step S110, the controller 60 determines whether or not to continue printing. If a next sheet of paper is to be printed, then the procedure is returned to step S102 and the next paper supply process is begun. If printing is not to be performed on a next sheet of paper, the printing operation is ended.

In step S104, if the controller 60 determines that the temperature of the carriage motor that has been detected is higher than the CRM threshold, then the procedure is advanced to step S108.

In step S108, the controller 60 performs a carriage motor cool down priority process. The carriage motor cool down priority process is described later with reference to FIG. 9 and FIGS. 10A to 10D. In step S108, when the carriage motor cool down priority process is over, the procedure is advanced to step S109.

In step S105, if the controller 60 determines that the temperature of the carry motor that has been detected is higher than the PFM threshold, then the procedure is advanced to step S107.

In step S107, the controller 60 performs a carry motor cool down priority process. The carry motor cool down priority process is described later with reference to FIG. 11 and FIGS. 12A to 12D. In step S107, when the carry motor cool down priority process is over, the procedure is advanced to step S109.

It should be noted that in this embodiment, the stop period of the motors during the carriage motor cool down priority process is longer than the stop period of the motors in the carry motor cool down priority process. Thus, if the carriage motor cool down priority process is performed, then it is conceivable that the carry motor 22 will be sufficiently cooled. Accordingly, in this embodiment, the determination of step S104 is performed before the determination of step S105.

<Normal Processing (S106)>

Figure 7:
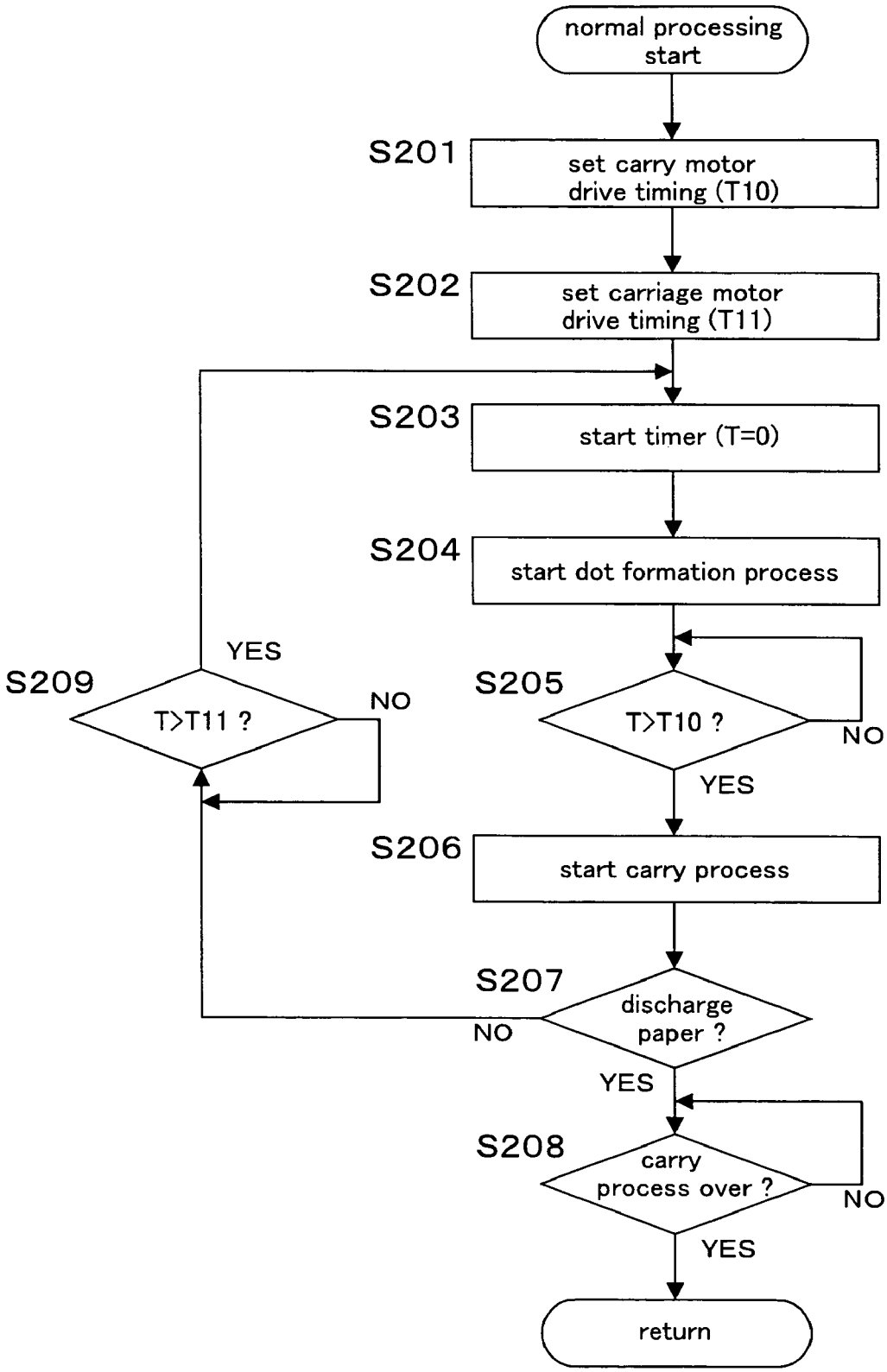
FIG. 7 is a flowchart of normal processing.
Figure 8:
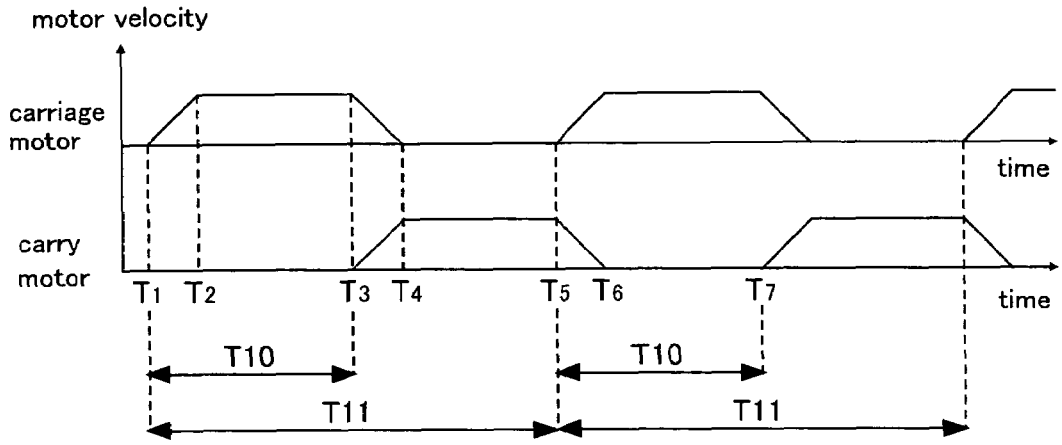
FIG. 8 is an explanatory diagram of the drive timing of the carriage motor and the carry motor during normal processing.

FIG. 7 is a flowchart of normal processing. FIG. 8 is an explanatory diagram of the drive state of the two motors during normal processing. It should be noted that in the following description, the drive period of the carriage motor 32 and the drive period of the carry motor are constant.

In step S201, the controller 60 performs a process for setting the drive timing of the carry motor. Here, the controller 60 sets a time T10 such that the carry motor 22 starts driving after the time T10 has elapsed from the start of driving of the carriage motor 32.

In step S202, the controller 60 performs a process for setting the drive timing of the carriage motor 32. Here, the controller 60 sets a time T11 such that the next driving of the carriage motor starts after the time T11 has elapsed from the start of driving of the carriage motor.

In step S203, the controller 60 resets the timer and then starts the timer. Accordingly, the elapsed time from this time point is indicated by the timer.

In step S204, the controller 60 starts dot formation. Dot formation is a process in which the carriage 31 is moved in the carriage movement direction and ink is intermittently ejected from the heat 41, which moves in tandem with the carriage 31, forming dots on the paper. First, from the time T1 to the time T2, the controller 60 drives the carriage motor 32 and accelerates the carriage 31. Next, from time T2 to time T3, the controller drives the carriage motor 32 to move the carriage 31 at a constant velocity. The controller 60 causes the head 41 to intermittently eject ink during the time that the carriage 31 is moving at a constant velocity. Then, the controller 60 slows driving of the carriage motor 32 from the time T3 to decelerate the carriage 31, thereby stopping the carriage motor 32 and also the carriage 31 at the time T4. The period from time T1 to time T4 is the period during which the carriage motor 32 is continually driven, and thus it is called the drive period of the carriage motor 32. When the dot formation process is started in step S204, the processes of accelerating, moving at constant velocity, and decelerating the carriage motor 32 are perform in tandem with the other process steps.

In step S205, the controller 60 determines whether or not the elapsed time from step S203 (the elapsed time from the start of the dot formation process) has passed the time T10. The time T10 is equivalent to the time from the start of driving of the carriage 31 to the end of ink ejection from the head 41 (the start of deceleration of the carriage 31). Thus, the elapsed time indicated by the timer will read T10 when the ejection of ink from the head 41 is over.

In step S206, the controller 60 starts the carry process. The carry process is the process of moving the paper in the carrying direction relative to the head 41. During the period from time T3 to time T6, the controller 60 drives the carry motor 22 to rotate the carry roller and thereby carry the paper in the carrying direction.

In step S207, the controller 60 determines whether or not to discharge the paper. If in step S207, the controller 60 determines that the paper is to be discharged, then the controller 60 returns the procedure to step S109 after the end of the carry process (YES in step S208). If in step S207, the controller 60 determines that the paper is not to be discharged, then the controller 60 advances the procedure to step S209.

In step S209, the controller 60 determines whether or not the elapsed time from step S203 (the elapsed time from the dot formation process) has passed the time T11. The time T11 is the time at which the carry motor will stop when the carriage starts moving at constant velocity if the dot formation process is started at this timing.

Once the elapsed time from step S203 has passed the time T11, the controller 60 resets the timer again (S203) and similarly repeats the dot formation process and the carry process. Thus, the dot formation process is started again (at time T5) when the time T11 has elapsed from the start of the previous dot formation process, and the carry process is started again (at time T7) when the time T10 has elapsed from the start of the dot formation process.

By performing this processing, the carriage motor 32 and the carry motor 22 each are repeatedly driven and stopped. Further, because the carriage motor 32 and the carry motor 22 are driven in alternation, one of the motors is stopped and cools down while the other motor is being driven, although a portion of their drive periods overlap. For example, the carry motor 22 is stopped and thus cools down while the carriage motor 32 is driving at a constant velocity.

It should be noted that driving of the carry motor 22 is started when the carriage motor 32 begins decelerating, and thus the timing at which the driving of the carry motor is started with respect to the stopping of the carriage motor 32 is fixed. Further, because the driving of the carriage motor 32 is started so that the carriage 31 starts moving at a constant velocity when the carry motor stops, the timing at which the driving of the carriage motor is started with respect to the stopping of the carry motor 22 is fixed.

<Carriage Motor Cool Down Priority Process (S108)>

COMPARATIVE EXAMPLE

Repeatedly driving the carriage motor 32 results in the carriage motor 32 generating heat and becoming hot. Therefore, when the temperature of the carriage motor 32 has exceeded 60° C. (when the detection result of the CRM temperature sensor 55 has exceeded 60° C.), it is necessary to increase the stop period of the carriage motor 32 in order to inhibit the temperature from rising further.

Figure 10A:
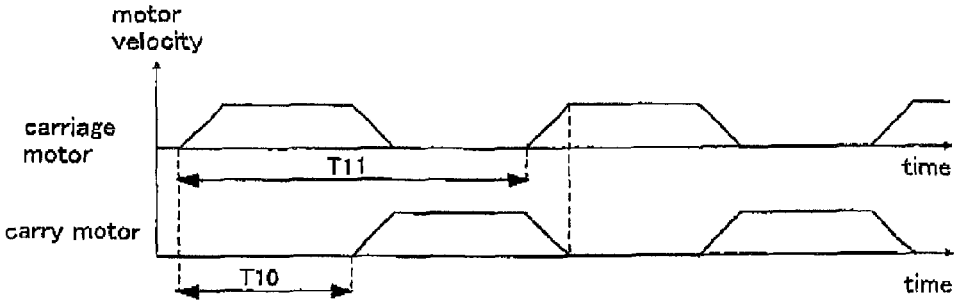
FIG. 10A is an explanatory diagram for describing the drive timing of the carriage motor and the carry motor when the printer executes normal printing.
Figure 10B:
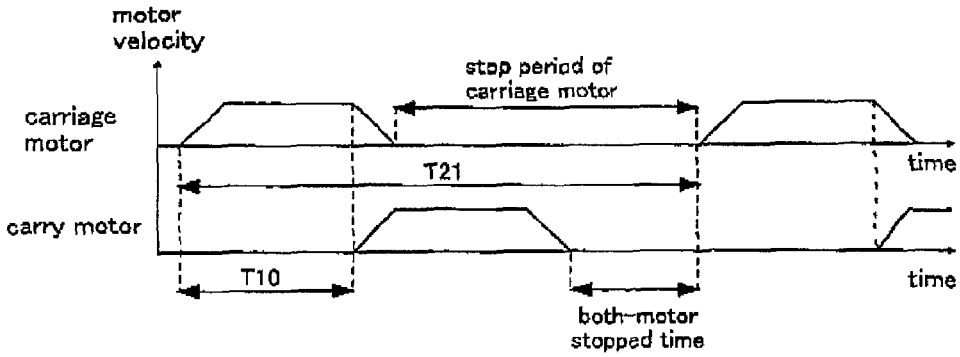
FIG. 10B is an explanatory diagram for describing how the drive interval of the carriage motor is lengthened beyond the normal drive interval.

FIG. 10A is an explanatory diagram of the drive timing of the two motors during normal processing. FIG. 10B is an explanatory diagram of a case in which the stop period of the carriage motor has simply been set long.

In normal processing, T11 is the time from the start of driving of the carriage motor to the next start of driving of the carriage motor. When the carriage motor has become hot it is necessary to set the drive timing of the carriage motor 32 to a time (T21) that is longer than T11 in order to cool down the carriage motor 32.

However, if there are no changes to the drive timing of the carry motor when the carriage motor has become hot, then the period during which both motors are stopped becomes long. For example, if the start of driving of the carry motor falls after the time T10 has elapsed from the start of driving of the carriage motor, as is the case during normal processing, then the state in which both motors are stopped continues for a long period after the carry motor has stopped.

When the both-motor stopped state becomes long in this manner, the user feels that the printing speed has dropped and this may become a source of stress for the user.

First Embodiment

Accordingly, in this embodiment, if the stop time of the carriage motor is going to be increased as described below, then the drive timing of the carry motor is set to be delayed so that the state in which both motors are stopped becomes short.

Figure 9:
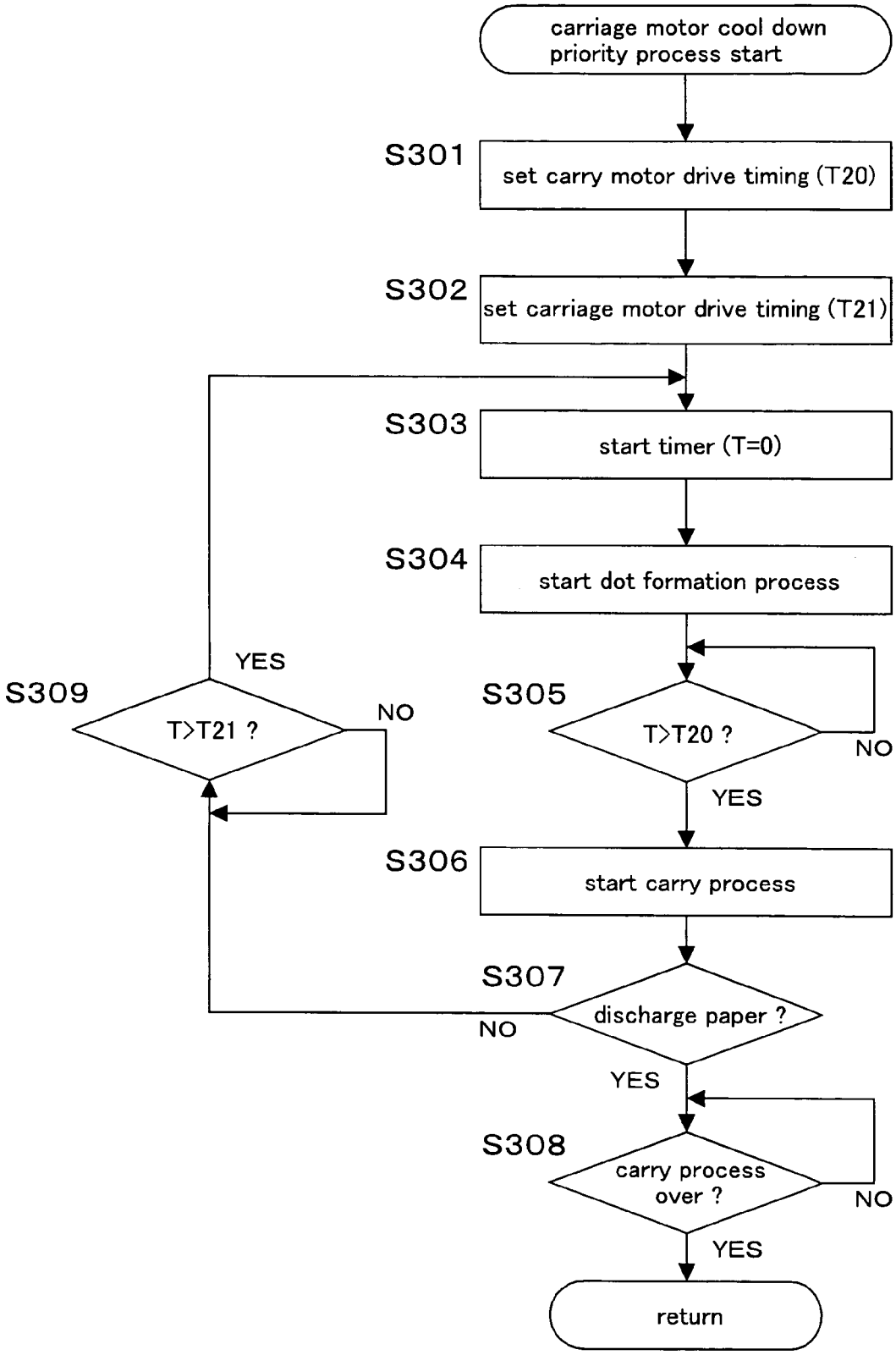
FIG. 9 is a flowchart of when the printer executes carriage motor cool down priority processing.
Figure 10C:
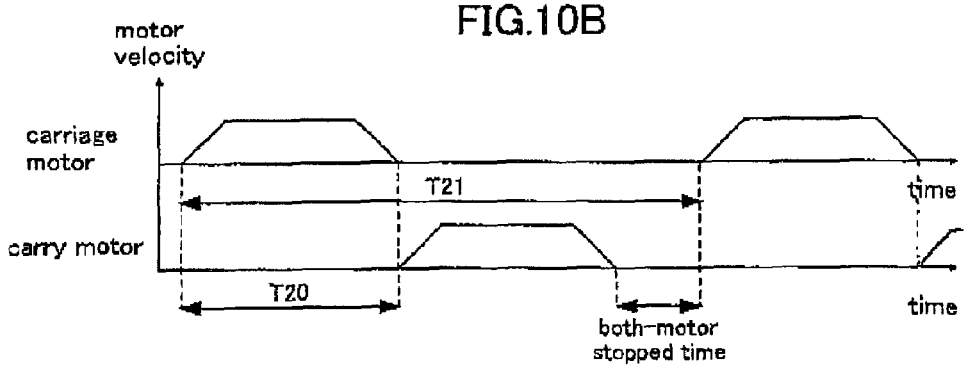
FIG. 10C is an explanatory diagram for describing how driving of the carry motor is started immediately after driving of the carriage motor is stopped.

FIG. 9 is a flowchart of the carriage motor cool down priority process of this embodiment. FIG. 10C is an explanatory diagram of the drive timing of the carriage motor and the carry motor according to this embodiment.

In this embodiment, in step S301, the controller 60 sets the drive timing of the carry motor to a time T20, which is longer than the time T10. Further, in step S302, the controller 60 sets the drive timing of the carriage motor to a time T21, which is longer than the time T11.

In step S303, the controller 60 resets and then restarts the timer. As a result, the time elapsed from that point is indicated by the timer.

In step S304, the controller 60 starts the dot formation process.

In step S305, the controller 60 determines whether or not the elapsed time from step S303 (the elapsed time from the start of the dot formation process) has passed the time T20. The time T20 is equivalent to the time from the start of driving to the end of driving of the carriage 31. Thus, when the carriage motor 32 stops, the elapsed time indicated by the timer is T20.

In step S306, the controller 60 starts the carry process. That is, driving of the carry motor 22 is started when the carriage motor 32 stops.

In step S307, the controller 60 determines whether or not to discharge the paper. If in step S307 the controller 60 determines that the paper should be discharged, then the controller 60 ends the carry process (YES in S308) and returns the procedure to step S109. If in step S307 the controller 60 determines that the paper is not to be discharged, then it advances the procedure to step S309.

In step S309, the controller 60 determines whether or not the elapsed time from step S303 (the elapsed time from the start of the dot formation process) has passed the time T21. The time T21 is the time from when the carriage motor 32 stopped until a stop period that is sufficient for the carriage motor 32 to cool down is over.

Once the elapsed time from step S303 has passed the time T21, the controller 60 resets the timer again (S303) and similarly repeats the dot formation process and the carry process. Thus, the dot formation process is started again when the time T21 has elapsed from the start of the previous dot formation process, and the carry process is started again when the time T20 has elapsed from the start of the dot formation process.

According to this embodiment, when the stop period of the carriage motor is made longer than that during normal processing, the timing at which driving of the carry motor is started with respect to the stopping of driving of the carriage motor is delayed compared to that of normal processing. As a result, the time during which both motors are driven simultaneously is eliminated, and thus the both-motor stopped state from when the carry motor stops until when the carriage motor starts to drive becomes shorter than in the comparative example.

For example, the both-motor stopped state was 0.3 seconds in the present embodiment, compared to 0.5 seconds in the comparative example. With the present embodiment, the both-motor stopped state is shortened and thus the user is less likely to feel that the printing speed has become slow, making it possible to keep the user from feeling undue stress.

In the present embodiment, when the detection results of the CRM temperature sensor 55 have exceeded 60° C., the carry motor drive timing is set to the time T20 and the carriage motor drive timing is set to the time T21. However, this is not a limitation. For example, because it becomes more necessary to lengthen the cool down period of the carriage motor the higher the temperature that the carriage motor becomes, it is also possible to set the carriage motor drive timing in accordance with the detection results of the CRM temperature sensor 55.

Second Embodiment

Figure 10D:
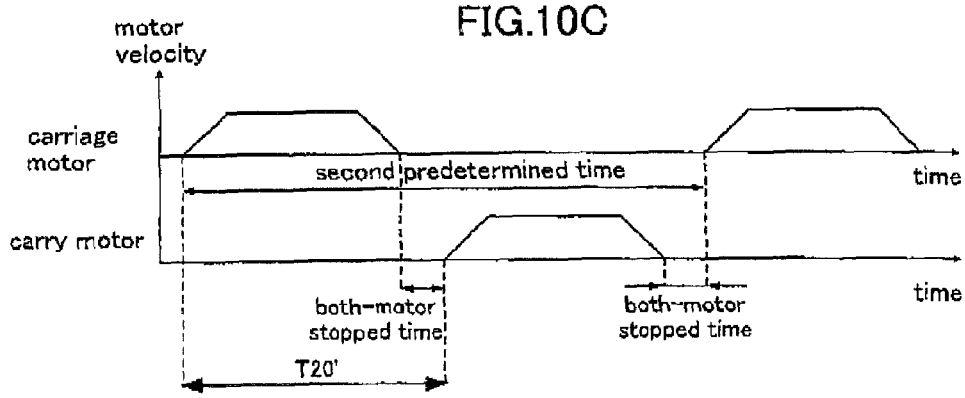
FIG. 10D is an explanatory diagram for describing how driving of the carry motor is started after a predetermined time has elapsed after driving of the carriage motor is stopped.

FIG. 10D is an explanatory diagram of the drive timing of the carriage motor and the carry motor according to another embodiment.

In this embodiment, the controller 60 in step S302 sets the drive timing of the carry motor to a time T20', which is longer than the time T20.

As a result, in this embodiment, unlike the foregoing embodiment, there is a both-motor stopped state in not only the period from after the carry motor stops until driving of the carriage motor is started, but also in the period from after the carriage motor stops until driving of the carry motor is started.

Thus, in this embodiment, the time during which both motors are stopped is dispersed. For example, in the previous embodiment, the time during which both motors were stopped was a continuous 0.3 seconds, whereas in this embodiment each is 0.15 seconds. Shortening the time during which both motors are stopped reduces the likelihood that users will feel that the printing speed has dropped, and this keeps the user from feeling an undue amount of stress.

In this embodiment as well, it is necessary to lengthen the cooling period of the carriage motor the higher the temperature that the carriage motor becomes, and therefore it is also possible to set the carriage motor drive timing in accordance with the detection results of the CRM temperature sensor 55. Further, in this embodiment, it is also possible to delay the drive timing of the carry motor in accordance with the detection results of the CRM temperature sensor 55 in order to disperse the time during which both motors are stopped. For example, the timing at which the carry motor is driven can be delayed the higher the temperature of the detection results of the CRM temperature sensor 55 is. Thus, the both-motor stopped time is equally dispersed between before and after the carry motor drive period.

<Carry Motor Cool Down Priority Process (S107)>

COMPARATIVE EXAMPLE

Repeatedly driving the carry motor 22 results in the carry motor 22 generating heat and becoming hot. Thus, when the temperature of the carry motor 22 has exceeded 55° C. (when the detection result of the PFM temperature sensor 56 exceeds 55° C.), it is necessary to increase the stop period of the carry motor 22 in order to keep the temperature from rising further.

Figure 12A:
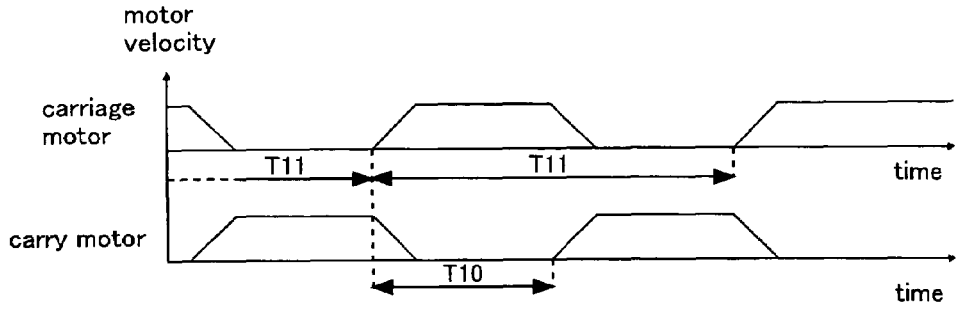
FIG. 12A is an explanatory diagram for describing the drive timing of the carriage motor and the carry motor when the printer executes normal printing.
Figure 12B:
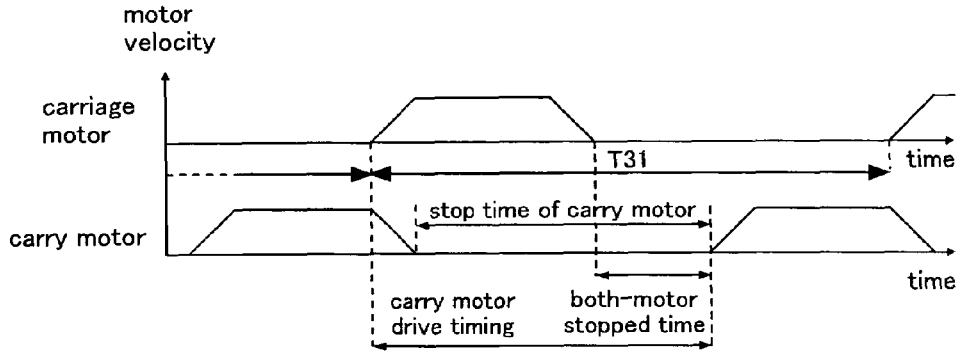
FIG. 12B is an explanatory diagram for describing how the drive interval of the carry motor is lengthened beyond the normal drive interval.

FIG. 12A is an explanatory diagram of the drive timing of the two motors during normal processing. FIG. 12B is an explanatory diagram of a case in which the stop period of the carry motor has simply been set long.

In normal processing, driving of the carry motor is started after the time T10 has elapsed from the start of driving of the carriage motor. When the carry motor has become hot, it is necessary to set the timing at which the carry motor 22 is driven to a time that is longer than T10 in order to cool the carry motor 22.

At this time, if there are no changes to the timing of starting driving the carriage motor with respect to the stopping of driving of the carry motor, then the period during which both motors are stopped becomes long.

When the period during which both motors are stopped becomes long in this manner, the user feels that the printing speed has dropped and this can become a source of stress for the user.

First Embodiment

Accordingly, in this embodiment, if the stop time of the carry motor is going to be lengthened as described below, then the carry motor is set to be driven at a faster timing so that the timing at which driving of the carriage motor is started is relatively delayed with respect to the stopping of the carry motor, thereby shortening the period during which both motors are stopped.

Figure 11:
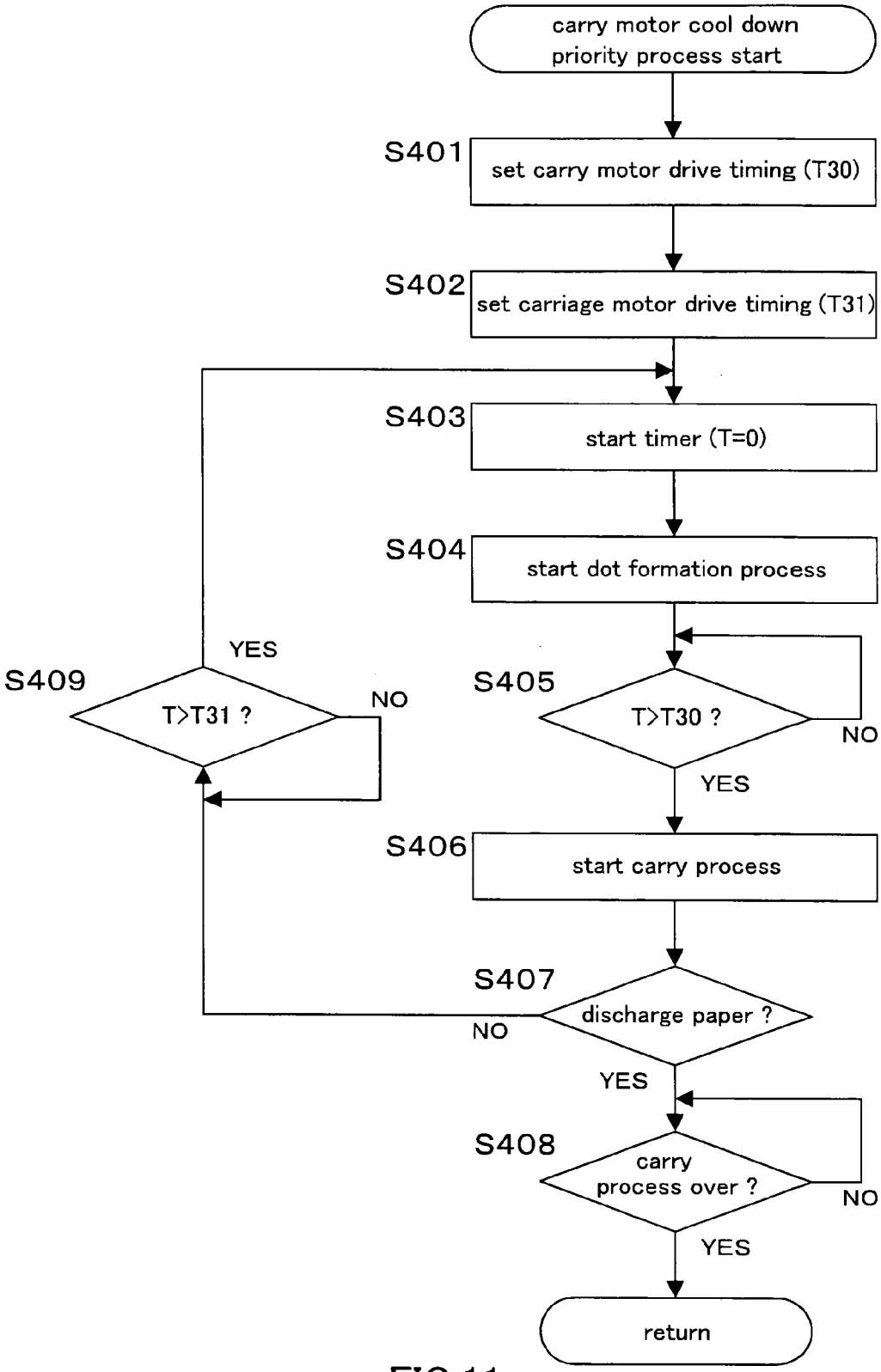
FIG. 11 is a flowchart of when the printer executes carry motor cool down priority processing.
Figure 12C:
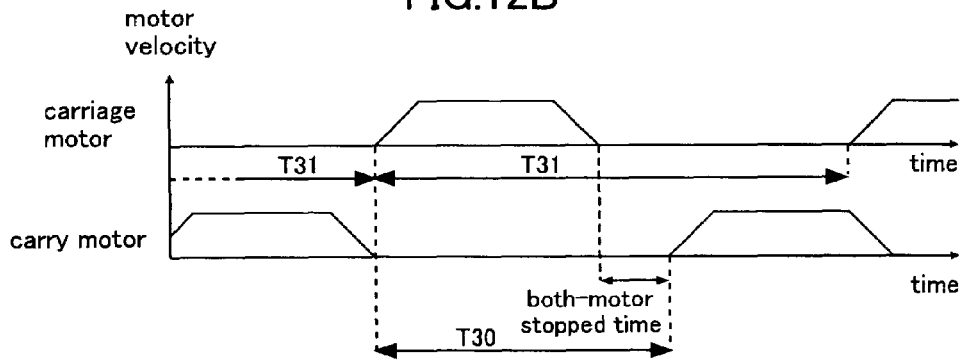
FIG. 12C is an explanatory diagram for describing how driving of the carriage motor is started immediately after driving of the carry motor is stopped.

FIG. 11 is a flowchart of the carry motor cool down priority process of this embodiment. FIG. 12C is an explanatory diagram of the drive timing of the carriage motor and the carry motor in this embodiment.

In this embodiment, in step S401 the controller 60 sets the drive timing of the carry motor to a time T30, which is longer than the time T10. Further, in step S402 the controller 60 sets the drive timing of the carriage motor to a time T31, which is longer than the time T11.

In step S403, the controller 60 resets the timer and then restarts the timer. Thus, the time elapsed from that point is indicated by the timer.

In step S404, the controller 60 starts the dot formation process.

In step S405, the controller 60 determines whether or not the elapsed time from step S403 (the elapsed time from the start of the dot formation process) has passed the time T30. The time T30 is the time from when the carry motor 22 stopped until when a stop period that is sufficient for the carry motor 22 to cool down is over.

In step S406, the controller 60 starts the carry process. In this embodiment, after the carriage motor 32 has stopped, there is a period during which both motors are stopped, and driving of the carry motor 22 is started after this period.

In step S407, the controller 60 determines whether or not to discharge the paper. If in step S407 the controller 60 determines that the paper should be discharged, then the controller 60 ends the carry process (YES in S408) and returns the procedure to step S109. If in step S407 the controller 60 determines that the paper is not to be discharged, then it advances the procedure to step S409.

In step S409, the controller 60 determines whether or not the elapsed time from step S403 (the elapsed time from the start of the dot formation process) has passed the time T31. The time T31 is the time at which, if the dot formation process is begun at this timing, the carriage motor begins driving when the carry motor 22 stops.

Once the elapsed time from step S403 has passed the time T31, the controller 60 resets the timer again (S403) and similarly repeats the dot formation process and the carry process. Thus, the dot formation process is started again when the time T31 has elapsed from the start of the previous dot formation process, and the carry process is started again when the time T30 has elapsed from the start of the dot formation process.

According to this embodiment, when the stop period of the carry motor is made longer than that during normal processing, the timing at which driving of the carriage motor 32 is started with respect to the stopping of driving of the carry motor 22 is delayed compared to that of normal processing. As a result, the time during which both motors are driven simultaneously is eliminated, and thus the both-motor stopped state from when the carriage motor stops until when the carry motor starts to drive becomes shorter than in the comparative example.

For example, the both-motor stopped state was 0.2 seconds in the present embodiment, compared to 0.4 seconds in the comparative example. With the present embodiment, the both-motor stopped state is shortened and thus the user is less likely to feel that the printing speed has become slow, thereby keeping the user from experiencing undue stress.

In the present embodiment, when the results of detection by the PFM temperature sensor 56 have exceeded 55° C., the carry motor drive timing is set to the time T30 and the carriage motor drive timing is set to the time T31. However, this is not a limitation. For example, because it becomes more necessary to lengthen the cool down period of the carry motor the higher the temperature that the carry motor becomes, it is also possible to set the carry motor drive timing in accordance with the detection results of the PFM temperature sensor.

Second Embodiment

Figure 12D:
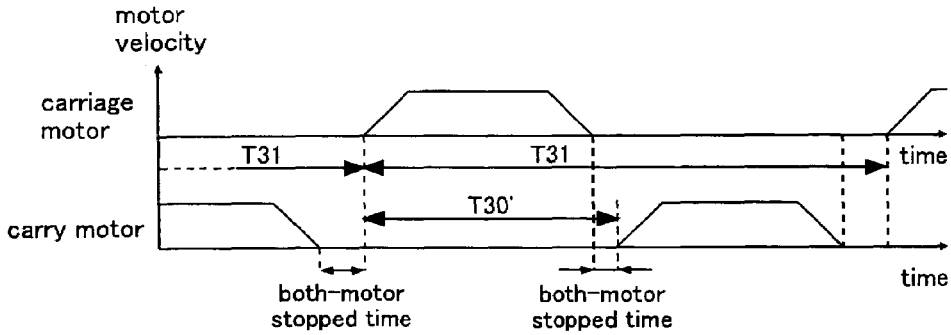
FIG. 12D is an explanatory diagram for describing how driving of the carriage motor is started after a predetermined time has elapsed after driving of the carry motor is stopped.

FIG. 12D is an explanatory diagram of the drive timing of the carriage motor and the carry motor according to another embodiment.

In this embodiment, the controller 60 in step S402 sets the drive timing of the carry motor to a time T30', which is shorter than the time T30.

As a result, in this embodiment, unlike the foregoing embodiment, there is a both-motor stopped state in not only the period from after the carriage motor has stopped until the start of driving of the carry motor, but also in the period from after the carry motor stops driving until the carriage motor starts to drive.

Thus, in this embodiment, the time during which both motors are stopped is dispersed. For example, in the previous embodiment, the time during which both motors are stopped is a continuous 0.2 seconds, whereas in this embodiment each is 0.1 seconds. Shortening the time during which both motors are stopped reduces the likelihood that users will feel that the printing speed has dropped, thereby keeping the user from feeling an undue amount of stress.

In this embodiment as well, it is necessary to lengthen the cooling period of the carry motor the higher the temperature that the carry motor becomes, and thus it is also possible to set the carry motor drive timing in accordance with the detection results of the PFM temperature sensor 56. It is preferable that the both-motor stopped periods before and after the carry motor drive period are equal.

===Other Embodiments===

A printing apparatus such as a printer, for example, according to the present invention was described through the above embodiments. However, the foregoing embodiments are for the purpose of elucidating the present invention and are not to be interpreted as limiting the present invention. The invention can of course be altered and improved without departing from the gist thereof and includes equivalents. In particular, the embodiments discussed below are also included in the printing apparatus according to the present invention.

In this embodiment, some or all of the configurations achieved by hardware may be replaced by software, and conversely, some of the configurations that are achieved by software can be replaced by hardware.

In addition to the print paper S, the printed object also may be cloth or film, for example.

In the foregoing embodiments, when the temperature of either the carriage motor or the carry motor exceeds a predetermined temperature, then the timing at which driving of the other motor is started falls either immediately after the driving of one of the motors has stopped or after a predetermined time has elapsed after driving of one of the motors has stopped.

However, the drive start timing of the other motor is not limited to this, and it is also possible to slightly delay the timing of the other motor compared to the timing at which it is normally driven.

Further, in the foregoing embodiments, a temperature sensor detects the temperature of either the carriage motor or the carry motor when printing of each medium is started. Then, if the temperature of either one of the carriage motor or the carry motor exceeds a predetermined temperature, the other motor is driven at a drive start timing that is delayed compared to the timing at which the motor is normally driven.

However, it is also possible for the temperature sensor to detect the temperature of either the carriage motor or the carry motor each time that the printer 1 prints a row of print data onto the medium (i.e., per each dot formation process).

<Regarding the Medium>

As regards the medium, it is possible to use regular paper, matte paper, cut paper, glossy paper, roll paper, sheet paper, photographic paper, and roll-type photographic paper, for example, as the paper described above. In addition to these, it is also possible to use film material such as OHP film or glossy film, cloth material, and sheet metal material, for example. In other words, any medium that may serve as an object of printing can be used.

===In Summary===

(1) The above inkjet printer (printing apparatus) is provided with a carriage motor (movement motor) for moving a head (ink ejecting section) that ejects ink onto a paper (medium), a carry motor for carrying the paper, and temperature sensors (CRM temperature sensor 55, PFM temperature sensor 56) for detecting the temperature of the respective motors. Driving and stopping of the motors are repeated in order to alternately perform a dot formation process and a carry process, and the carriage motor and the carry motor are driven in alternation such that the timing at which one of the motors starts to drive is at a predetermined timing with respect to the timing at which driving of the other motor stops.

In such a printer, the motors generate heat during the period that they are driven, and cool down during the period that they are stopped. If the temperature of a motor becomes elevated, then it is necessary to sufficiently cool that motor. Accordingly, if for example the results of detection by the CRM temperature sensor 56 exceed the CRM threshold value (predetermined temperature) of 60° C., then the stop time of the carriage motor is made longer than that during normal processing (i.e., longer than before the detection result of the temperature sensor exceeds the predetermined temperature).

However, there is a possibility that the both-motor stopped state will become longer if the period during which the carriage motor is stopped is lengthened (see FIG. 10B). Similarly, if the period during which the carry motor is stopped is lengthened, then there is a possibility that the both-motor stopped state will become long (see FIG. 12B). When the state in which both motors are stopped becomes long, the drop in printing speed is noticeable to the user, and this may cause the user stress.

Accordingly, with the printer discussed above, the timing at which driving of the carry motor is started with respect to the stopping of driving of the carriage motor is delayed compared to that of normal processing when the detection results of the CRM temperature sensor exceed the CRM threshold (see FIG. 10C). Similarly, the timing at which driving of the carriage motor is started with respect to the stopping of driving of the carry motor is delayed compared to that of normal processing when the detection results of the PFM temperature sensor exceed the PFM threshold (see FIG. 12C).

Thus, the state in which both motors are stopped is shortened, keeping the user from experiencing undue stress.

It should be noted that the above-described printer is provided with a temperature sensor for each motor, but this is not a limitation. It is also possible to provide a temperature sensor for only one of the motors.

(2) With the above printer, when the temperature of the carriage motor becomes elevated, the printer transitions from normal processing to carriage motor cool down priority processing, in which the time during which the carriage motor is stopped is changed to a longer time. Similarly, when the temperature of the carry motor becomes elevated, the printer transitions from normal processing to carry motor cool down priority processing, in which the time during which the carry motor is stopped is changed to a longer time. Thus, when cooling a motor becomes necessary, its stop time is lengthened to allow for radiation of the motor's heat.

(3) The above printer is provided with a CRM temperature sensor for detecting the temperature of the carriage motor and a PFM sensor for detecting the temperature of the carry motor. When the detection results of the respective temperature sensor exceed a predetermined threshold, the printer transitions from normal processing to cool down priority processing, and thus the stop time of the respective motor is changed to a longer time. Thus, when the temperature of a motor becomes high, its stop time is lengthened to allow for radiation of the motor's heat.

It should be noted that the above printer is provided with a temperature sensor for each motor, but this is not a limitation. It is also possible to provide only one of the motors with a temperature sensor.

(4) The above printer is provided with temperature sensors for detecting motor temperature, but this is not a limitation. It is also possible to not provide the printer with temperature sensors. However, in this case the temperature of the motors can no longer be directly detected.

In this case, the temperature of the motor is calculated based on the drive amount of the motor. Here, the drive amount of the carriage motor could be the carriage movement amount, the number of dot formation processes, or the number of sheets of paper printed, for example. Similarly, the drive amount of the carry motor could be the medium carry amount, the number of carry processes, or the number of sheets of paper printed, for example. A function or table for calculating the temperature of the motor from the drive amount of the motor would be stored in advance on the printer. The printer would then detect the drive amount of the motor and calculate the temperature of that motor based on the detected drive amount of the motor and a stored function, for example.

Then, when the drive amount of the motor becomes large and the calculated temperature exceeds a threshold vale, the printer lengthens the stop time of the motor in order to allow the radiation of heat from the motor.

By doing this it is not necessary to provide temperature sensors, and thus a reduction in apparatus costs can be achieved.

(5) In the above printer it is possible to set the stop time of the carriage motor, for example, based on the temperature that has been detected by the CRM temperature sensor. For example, when the temperature that is detected by the CRM temperature sensor is 70° C., then the stop time can be set longer than when the temperature that is detected by the CRM temperature sensor is 60° C. By doing this, it is possible to perform cooling that is appropriate for the temperature of the motor.

(6) In the above printer, during normal printing (i.e., before the detection result of the temperature sensor exceeds the predetermined temperature) there is a state in which both motors are driven simultaneously. For example, driving of the carry motor is started when the carriage motor begins to slow down, and thus until the carriage motor stops, the two motors are driven simultaneously. Further, the carriage motor starts accelerating while the carry motor is being driven, and thus both motors are driven simultaneously while the carriage motor is accelerating.

By shortening or eliminating the time during which both motors are driven simultaneously during cool down priority processing, it becomes possible to shorten the both-motor stopped state.

(7) With the above printer, during normal processing (i.e., before the detection result of the temperature sensor exceeds the predetermined temperature) the driving of the carry motor is started before driving of the carriage motor is stopped, for example. Thus, the printing speed during normal processing is increased.

(8) With the above printer, during normal processing (i.e., before the detection result of the temperature sensor exceeds the predetermined temperature) the driving of the carry motor is started when the carriage motor (movement motor) begins to decelerate. The ejection of ink from the head has finished when the carriage motor starts decelerating, and thus driving of the carry motor can be started. Thus, the printing speed during normal processing is increased.

(9) With the above printer, for example during carriage motor cool down priority processing (i.e., when the detection result of the temperature sensor exceeds the predetermined temperature) the driving of the carry motor was started at the same time that the carriage motor stops (see FIG. 10C). This accordingly eliminates the state during which both motors are simultaneously driven, thereby shortening the state in which both motors are stopped.

(10) With the above printer, for example during carriage motor cool down priority processing (i.e., when the detection result of the temperature sensor exceeds the predetermined temperature) the driving of the carry motor was started after the carriage motor has stopped (see FIG. 10D). Thus, the state during which both motors are simultaneously driven is eliminated, thereby shortening the both-motor stopped state.

(11) With the above printer, there is a both-motor stopped state (a period during which neither the movement motor nor the carry motor are driven) before driving and after driving of, for example, the carry motor (see FIG. 10D). Thus, the state in which both motors are stopped can be dispersed, thereby making it less likely that the user will feel that the printing speed has decreased.

(12) With the above printer, when the stop time has become longer than before being changed, the timing at which either one of the motors starts to drive is delayed such that the both-motor stopped time (the time during which both motors are kept in a continuously stopped state) is shortened. For example, as for the carriage motor cool down priority processing, the both-motor stopped time is 0.5 seconds in the comparative example of FIG. 10B, whereas in the first embodiment shown in FIG. 10C, the both-motor stopped time is shortened to 0.3 seconds by delaying the starting of driving of the carry motor by 0.2 seconds. Further, in the second embodiment shown in FIG. 10D, the both-motor stopped time is shortened to 0.15 seconds by delaying the starting of driving of the carry motor by 0.35 seconds.

By shortening the time during which both motors are kept in a continuously stopped state in this way, it is less likely for the user to feel that the printing speed has dropped.

(13) With the above printer, when the stop time has become longer than before being changed, the other motor is not driven while the one motor is being driven. For example, before changing the stop time, as shown in FIG. 10A, there is a period in which both motors are driven from when the carry motor starts to drive until when the carriage motor stops. On the other hand, after lengthening the stop time, there is no period in which both motors are driven at the same time, neither in the first embodiment shown in FIG. 10C nor in the second embodiment shown in FIG. 10D. Thus, it is possible to shorten the both-motor stopped time as much as possible.

(14) In the foregoing embodiments, the stop period of a motor was lengthened by a predetermined time when the temperature of the carriage motor and/or the carry motor became high. However, as described above, since it is necessary to lengthen the motor cool-down period in accordance with the temperature, the controller 60 may determine the stop period in accordance with the temperature. In this case, the controller 60 first determines the stop period of one of the motors in accordance with the temperature, and then determines the timing at which to start driving the other motor in accordance with this stop period.

For example, assume that the controller 60 is driving the carriage motor and the carry motor according to the state shown in FIG. 10D at a certain temperature, and that the controller 60 determines to lengthen the stop period of the carriage motor by a further 0.2 seconds because the temperature of the carriage motor has further elevated. In this case, the controller 60 further delays the timing at which to start driving the carry motor by 0.1 seconds. Accordingly, the both-motor stopped time becomes 0.2 seconds. It should be noted that if the controller 60 does not change the timing at which to start driving the carry motor from the state of FIG. 10D, then the both-motor stopped time will be 0.35 seconds at the maximum.

What is claimed is:

1. A printing method comprising:

preparing a printing apparatus that is provided with a movement motor for moving an ink ejecting section that ejects ink onto a medium, and a transport motor for transporting said medium;

repeating driving and stopping of both motors, and alternately driving said movement motor and said transport motor, wherein in a normal operation, each motor repeats respectively a drive time from when driving starts to when driving stops, and a stop time from when the driving stops to when the driving starts, and when the stop time of said one motor has been changed to become longer than said stop time in the normal operation, a timing at which driving of the other motor starts in respect to a timing at which driving of the one motor stops is delayed.

2. A printing method according to claim 1, wherein said stop time of said one motor is changed according to a temperature of said one motor.

3. A printing method according to claim 2, wherein said printing apparatus further comprises a temperature sensor for detecting the temperature of said one motor; and wherein, when a detection result of said temperature sensor exceeds a predetermined temperature, the stop time of said one motor is made longer than before the detection result of said temperature sensor exceeds said predetermined temperature.

4. A printing method according to claim 2, wherein the temperature of said one motor is calculated based on a drive amount of said one motor; and wherein said stop time of said one motor is changed according to the temperature of said one motor that has been calculated.

5. A printing method according to claim 2, wherein the stop time of said one motor is set according to the temperature of said one motor.

6. A printing method according to claim 1, wherein, before changing said stop time to make said stop time become longer, there is a state where said one motor and said other motor are driven simultaneously.

7. A printing method according to claim 6, wherein, before changing said stop time to make said stop time become longer, driving of said other motor is started before driving of said one motor is stopped.

8. A printing method according to claim 7, wherein, before changing said stop time to make said stop time become longer, driving of said other motor is started when said one motor begins to decelerate.

9. A printing method according to claim 6, wherein, when said stop time has become longer than in the normal operation, driving of said other motor is started at the same time that said one motor is stopped.

10. A printing method according to claim 6, wherein, when said stop time has become longer than in the normal operation, driving of said other motor is started after said one motor has stopped.

11. A printing method according to claim 10, wherein, when said stop time has become longer than in the normal operation, there are periods during which neither said movement motor nor said transport motor are driven, before said other motor starts to drive and after said other motor has stopped driving.

12. A printing method according to claim 1, wherein, when said stop time has become longer than in the normal operation, the timing at which said other motor starts to drive is delayed compared to said predetermined timing such that a time during which both said movement motor and said transport motor are kept in a continuously stopped state becomes shorter.

13. A printing method according to claim 1, wherein, when said stop time has become longer than in the normal operation, said other motor is not driven while said one motor is being driven.

14. A printing method according to claim 1, wherein, after said stop time of said one motor has been determined, the timing at which said other motor starts to drive is determined according to said stop time that has been determined.

15. A printing method comprising the steps of:

preparing a printing apparatus that is provided with a movement motor for moving an ink ejecting section that ejects ink onto a medium, and a transport motor for carrying said medium;

repeating driving and stopping of both motors, and alternately driving said movement motor and said transport motor such that a timing, with respect to a timing at which one motor stops driving, repeating driving and stopping of both motors, and alternately driving said movement motor and said transport motor, wherein in a normal operation, each motor repeats respectively a drive time from when driving starts to when driving stops, and a stop time from when the driving stops to when the driving starts, and when the stop time of said one motor has been changed to become longer than said stop time in the normal operation, a timing at which driving of the other motor starts in respect to a timing at which driving of the one motor stops is delayed;

wherein said stop time of said one motor is changed according to a temperature of said one motor;

wherein the temperature of said one motor is calculated based on a drive amount of said one motor;

wherein said stop time of said one motor is changed according to the temperature of said one motor that has been calculated;

wherein the stop time of said one motor is set according to the temperature of said one motor;

wherein, before changing said stop time to make said stop time become longer, there is a state where said one motor and said other motor are driven simultaneously, driving of said other motor is started before driving of said one motor is stopped, and driving of said other motor is started when said one motor begins to decelerate;

wherein, when said stop time has become longer than before being changed, driving of said other motor is started after said one motor has stopped, there are periods during which neither said movement motor nor said transport motor are driven, before said other motor starts to drive and after said other motor has stopped driving, the timing at which said other motor starts to drive is delayed compared to said predetermined timing such that a time during which both said movement motor and said transport motor are kept in a stopped state becomes shorter, and said other motor is not driven while said one motor is being driven; and wherein, after said stop time of said one motor has been determined, the timing at which said other motor starts to drive is determined according to said stop time that has been determined.

16. A printing apparatus comprising:

a movement motor for moving an ink ejecting section that ejects ink onto a medium; and a transport motor for carrying said medium;

wherein both motors are repeatedly driven and stopped;

wherein a stop time of at least one motor of said movement motor and said transport motor is changeable;

wherein said movement motor and said transport motor perform driving alternately such that a timing, with respect to a timing at which said one motor stops driving; and repeating driving and stopping of both motors, and alternately driving said movement motor and said transport motor, wherein in a normal operation, each motor repeats respectively a drive time from when driving starts to when driving stops, and a stop time from when the driving stops to when the driving starts, and when the stop time of said one motor has been changed to become longer than said stop time in the normal operation, a timing at which driving of the other motor starts in respect to a timing at which driving of the one motor stops is delayed.

* * * * *